United States Patent [19]

Roccaforte

[11] 4,020,947

[45] May 3, 1977

[54] CARTON SUSPENSION

[75] Inventor: Harry I. Roccaforte, Western Springs, Ill.

[73] Assignee: Hoerner Waldorf Corporation, Saint Paul, Minn.

[22] Filed: Mar. 15, 1976

[21] Appl. No.: 666,956

[52] U.S. Cl. ..... 206/45.31; 206/491; 206/806; 229/52 B

[51] Int. Cl.[2] ..... B65D 5/06; B65D 5/46

[58] Field of Search ..... 206/45.31, 45.33, 491, 206/806; 229/52 B; 248/173, 318

[56] References Cited

UNITED STATES PATENTS

| | | | |
|---|---|---|---|
| 1,974,038 | 9/1934 | Baxter | 206/491 |
| 2,042,799 | 6/1936 | Ort | 206/806 X |
| 2,659,524 | 11/1953 | McElwee | 229/52 B X |
| 2,711,346 | 6/1955 | Irwin et al. | 206/45.33 X |
| 2,713,453 | 7/1955 | Williamson | 206/45.31 X |
| 2,802,616 | 8/1957 | Caster et al. | 229/52 B |
| 3,254,759 | 6/1966 | Britton | 206/45.31 |
| 3,563,369 | 2/1971 | Aldrich | 206/45.33 X |
| 3,627,115 | 12/1971 | Samalon | 206/45.33 X |
| 3,790,066 | 2/1974 | Malinowski | 229/52 B |

FOREIGN PATENTS OR APPLICATIONS

| | | | |
|---|---|---|---|
| 231,940 | 4/1925 | United Kingdom | 229/52 B |

*Primary Examiner*—Stephen Marcus
*Attorney, Agent, or Firm*—Jerry Best

[57] ABSTRACT

A double thickness improved carton suspension including a die-cut hinged section formed in a panel of the carton with a flap hingedly attached along one edge of the carton having a die-cut tab connected along its outer edge so that when the flap is folded underneath and in overlapping relationship with the carton panel the tab and the die-cut section may be moved together into an upright position normal to the plane of the carton panel so that the carton may be suspended through the use of two cooperating apertures in both the tab and the die-cut section.

2 Claims, 3 Drawing Figures

CARTON SUSPENSION

BACKGROUND OF THE INVENTION

1. Field of the Invention

This disclosure relates generally to means formed as a portion of a carton which may be folded outwardly to provide a suspension point for hanging the carton such as for display purposes.

2. Description of the Prior Art

Modern merchandising often requires that objects be capable of being put on display racks where the racks consists of a backboard with outwardly extending hooks. Many times objects which are to be displayed in this manner are placed on film overwrapped cards which have apertures punched in them, but there is also a need for a carton style for larger heavier objects which will allow the carton to be shipped in its normal rectangular configuration and then be altered so that it will fit on a display hook and at the same time have sufficient strength so that the carton will not tear away if the object contained therein is relatively heavy.

SUMMARY OF THE INVENTION

A double thickness carton suspension including a die cut area in a panel with an adjacent flap to that panel and a tab extending from that flap which is foldable under the panel into conformity with the panel and provides that the tab may be foldable along with the die cut section up to a position normal to the panel of the carton to provide a double thickness suspension with a cooperating aperture die cut through both the tab and die cut section.

DESCRIPTION OF THE PREFERRED EMBODIMENT

Figure 1:
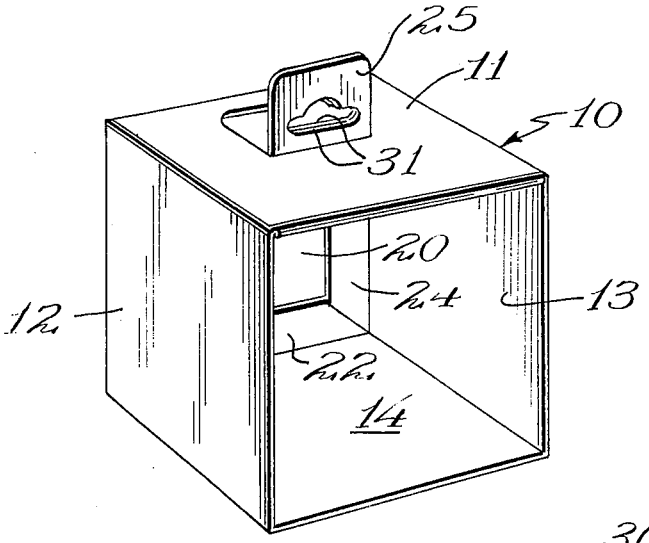
FIG. 1 is a perspective view of a carton embodying the present invention.
Figure 2:
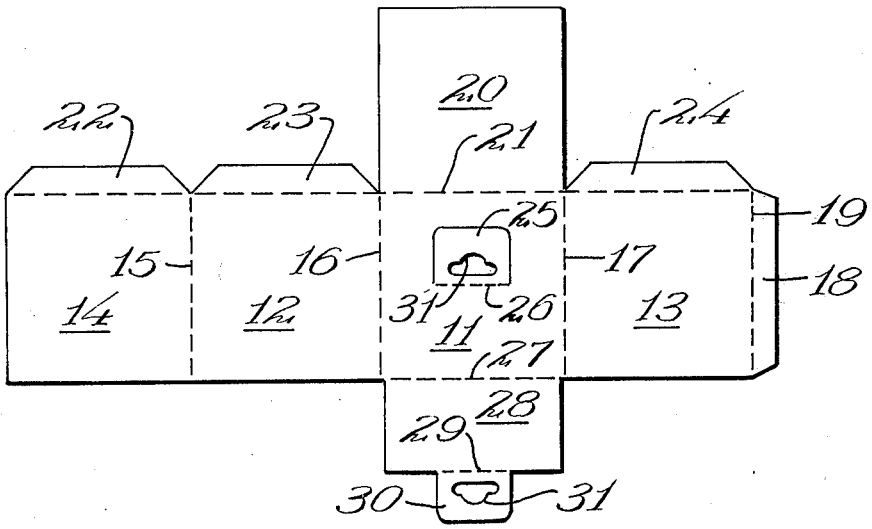
FIG. 2 is a plan view of a blank adapted to be folded into a carton such as that shown in FIG. 1.

Although there are many carton configurations which may utilize the present invention, one in which it is most applicable is one shown generally as 10 in FIG. 1 which is large enough that it may hold an object such as an oil filter or similar heavy object which is to be mass merchandised in stores. The particular carton 10 which is shown in FIG. 1 has an open front so that an object may be placed in the carton and a film overwrap applied thereto so that the object may be seen and may become a part of the display. The carton is one formed from a blank such as that shown in FIG. 2 which includes a top panel 11, side panels 12 and 13, and a bottom panel 14, all being hingedly connected by the three vertical parallel fold lines 15, 16, and 17. At one end of this series of similar rectangular panels is a manufacturer's glue flap 18 connected along a horizontal fold line 21, which horizontal fold line 21 also serves to connected glue flaps 22, 23 and 24 which provide rigidity of the carton and serve to hold the back panel 20 in position.

Figure 3:
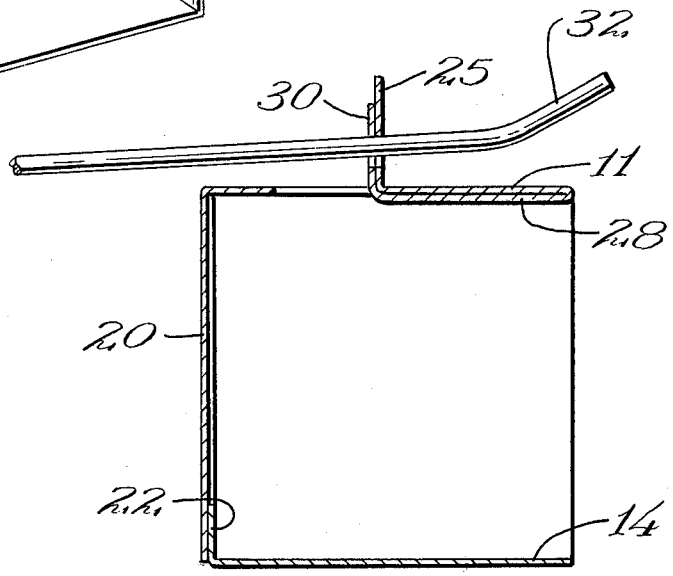
FIG. 3 is a side elevation section view illustrating how the carbon may be located on a display hook as a part of a rack display.

The top panel 11 has formed therein a die cut section which includes a die cut section 25 which is defined by a line cut on three of its four rectangular sides and a fourth side defined by a horizontal fold line 26 which is shown positioned near the center of the carton, and should be positioned at a point which will be above the center of gravity of the entire carton so that when the package is placed on the display hook it will hang vertically. Along a bottom edge of the front panel 11 and attached along a horizontal fold line 27 is a spacing flap 28 which has attached along a horizontal fold line 29 a reinforcing tab 30 which is formed similar in shape and configuration to the die cut section 25. The tab 30 is spaced from the horizontal fold line 27 a distance substantially equal to the distance from that horizontal fold line 27 to the fold line 26 within the die cut section 25. Such a spacing is necessary to provide proper alignment when the flap 28 is folded underneath and into contiguous relationship with the top panel 11. The die cut sections 25 and tab 30 each have an aperture section 31 die cut therefrom. It may be seen in FIG. 1 that the contiguous sections 25 and 30 may be left flat and parallel to the carton panel 11 during shipment and during display and sale in the stores if a hook-type rack is not to be employed. If it is to be employed, the two sections are simply folded up to the position shown in FIG. 1 and the carton is then placed on a hook 32, such as is shown in FIG. 3, the double thickness providing adequate strength and yet being incorporated in a carton which is simple and may be glued on conventional equipment without the need for special tooling.

I claim:

1. A carton suspension formed integrally with a paperboard blank adapted to be folded into a rectangular paperboard carton, said blank comprising four adjacent panels adapted to be folded to form top, bottom and side wall panels of the carton, panels connected to said rectangular panels and adapted to be folded as at least a back panel for said carton; said suspension comprising:

a die-cut section formed in said top panel and positioned within the border of said top panel, said section connected to said top panel along a first fold line extending parallel to said back panel of said carton;

a spacing flap hingedly attached to said top panel by a second fold line parallel to said first fold line and positioned along the exposed edge of said top panel opposite said back panel;

reinforcing means hingedly attached along a third hinge line to said flap, said reinforcing means being formed in shape substantially similar to said die-cut section, and said third fold line being spaced from second fold line a distance substantially equal to the spacing between said first and second fold lines; and said die cut section and said reinforcing means having formed therein apertures which when folded together are of substantially similar shape and size.

2. A rectangular carton having at least top, bottom, back and side walls with a reinforced suspension formed integrally with said top panel, said suspension comprising:

a die-cut section spaced within the border of said top panel connected to said top panel by a first fold line parallel to said back panel;

a spacer flap folded into juxtaposition with the inner facing surface of said top panel;

reinforcing means hingedly attached to said spacer flap along a hinge line substantially underlying said first fold line connecting said die cut section;

cooperating overlying apertures cut in both said reinforcing means and said die-cut section.

* * * * *